US011472213B2

(12) United States Patent
McFarlane

(10) Patent No.: US 11,472,213 B2
(45) Date of Patent: Oct. 18, 2022

(54) APPARATUS AND METHOD FOR SPRAY TREATING FABRIC

(71) Applicant: Durst Group AG, Brixen (IT)

(72) Inventor: David McFarlane, Carnforth (GB)

(73) Assignee: DURST GROUP AG, Brixen (IT)

( * ) Notice: Subject to any disclaimer, the term of this patent is extended or adjusted under 35 U.S.C. 154(b) by 106 days.

(21) Appl. No.: 16/491,327

(22) PCT Filed: Jan. 26, 2018

(86) PCT No.: PCT/GB2018/050241
§ 371 (c)(1),
(2) Date: Sep. 5, 2019

(87) PCT Pub. No.: WO2018/162872
PCT Pub. Date: Sep. 13, 2018

(65) Prior Publication Data

US 2020/0016913 A1 Jan. 16, 2020

(30) Foreign Application Priority Data

Mar. 7, 2017 (GB) ..... 1703599

(51) Int. Cl.
*B05B 13/04* (2006.01)
*B41J 11/00* (2006.01)
(Continued)

(52) U.S. Cl.
CPC ..... *B41M 5/0017* (2013.01); *B05B 13/0473* (2013.01); *B41J 3/4078* (2013.01);
(Continued)

(58) Field of Classification Search
CPC ..... B41M 5/0017; B05B 13/0473; B05B 13/0468; B41J 3/4078; B41J 11/0015;
(Continued)

(56) References Cited

U.S. PATENT DOCUMENTS 2,770,216 A 11/1956 Schock
4,156,041 A * 5/1979 Gilbert ..... B29C 44/461 427/244
(Continued)

FOREIGN PATENT DOCUMENTS

DE 2928563 A1 1/1981
GB 210361 1/1924
(Continued)

OTHER PUBLICATIONS

Combined Search and Examination Report for Great Britain Application No. GB1703599.9; dated Jun. 14, 2017; 6 pages.
(Continued)

*Primary Examiner* — Alexander M Weddle
(74) *Attorney, Agent, or Firm* — Shumaker, Loop & Kendrick, LLP

(57) ABSTRACT

A spray coating apparatus is provided, wherein a nozzle is arranged to traverse a fabric in one direction whilst simultaneously spraying and oscillating in another direction. The fabric is spray coated with a first pass having a spray zone having uneven distribution in the direction of oscillation, and particularly with a greater density of fluid coverage toward the centre of the spray zone than an edge. The nozzle forming a second and subsequent pass that is off-set from the first and each subsequent pass respectively. The second and each subsequent pass being arranged to overlap with a portion of the previous pass, thereby providing an improved distribution of the spray coating. Moreover, because the spray coating is incremental, the method is easily adaptable to integrate with an ink jet printing process.

18 Claims, 10 Drawing Sheets

(51) Int. Cl.

| | |
|---|---|
| ***B41J 3/407*** | (2006.01) |
| ***D06B 1/02*** | (2006.01) |
| ***D06P 5/00*** | (2006.01) |
| ***B41M 5/00*** | (2006.01) |

(52) U.S. Cl.
CPC ..... *B41J 11/0015* (2013.01); *D06B 1/02* (2013.01); *D06P 5/002* (2013.01)

(58) Field of Classification Search
CPC . B41J 29/17; D06B 1/02; D06B 15/00; D06B 23/30; D06P 5/002
See application file for complete search history.

(56) References Cited

U.S. PATENT DOCUMENTS

| | | | | |
|---|---|---|---|---|
| 4,282,729 | A | 8/1981 | Smith | |
| 6,036,123 | A * | 3/2000 | West | E04D 15/07 239/587.5 |
| 7,118,629 | B2 * | 10/2006 | Davidson | B05B 13/005 118/323 |
| 2006/0238565 | A1 | 10/2006 | Jung et al. | |
| 2010/0279081 | A1 * | 11/2010 | Koele | D06M 23/16 428/195.1 |

FOREIGN PATENT DOCUMENTS

| | | | |
|---|---|---|---|
| GB | 1543729 | A | 4/1979 |
| GB | 2059814 | A | 4/1981 |
| WO | 2005028731 | A1 | 3/2005 |
| WO | 2010125129 | A1 | 11/2010 |
| WO | 2018162872 | A1 | 9/2018 |

OTHER PUBLICATIONS

Written Opinion of the International Searching Authority for International Application No. PCT/GB2018/050241; dated Sep. 13, 2018; 7 pages.
International Search Report for or International Application No. PCT/GB2018/050241; dated Sep. 13, 2018; 5 pages.

* cited by examiner

APPARATUS AND METHOD FOR SPRAY TREATING FABRIC

CROSS REFERENCE TO RELATED PATENT APPLICATIONS

This application claims the benefit of and priority to PCT/GB2018/050241 filed Jan. 26, 2018 which claims the benefit of and priority to Great Britain Application No. 1703599.9 filed on Mar. 7, 2017.

TECHNICAL FIELD AND BACKGROUND OF THE INVENTION

FIELD

The disclosure relates to an improved apparatus and method for treating a substrate and in particular to a substrate that can be wound and unwound from a roll or wheel such as a fabric or card or corrugated card. However, the apparatus is particularly suited to use with treating fabric.

BACKGROUND

It is known that fabrics have to be pre-treated with chemicals prior to digital printing in order to fix the printed ink. The pre-treatment chemicals are tailored to the type of ink. A typical process includes immersing the fabric in a chemical bath to treat it, drying the fabric and then printing onto the fabric. This pre-treatment process prior to the inkjet printing is often referred to as a padding and stenter process.

A known apparatus (1) for pre-treating fabric is shown schematically in FIG. 1. Typically, untreated fabric is provided as a roll (2). Optionally, the fabric (10) can be fed as a continuous sheet through a cleaner (3) to remove any lint broken down from the fabric (10) when unrolling and any dust present on the fabric (10). The fabric (10) is then submersed in a chemical bath (4) so that the fabric (10) becomes fully embedded with the pre-treatment chemicals. The pre-treatment chemicals are selected to meet the printing requirements. However, because the fabric (10) is immersed in the chemical bath, it is not easy to change the pre-treatment chemicals, for example in order to facilitate a change in printing ink type, without affecting down-time or fabric (10) integrity.

During the pre-treatment phase, lint and/or dust may further accumulate on the fabric (10) and may need to be further removed by another cleaning station (not shown). Once clean, the fabric (10) is then passed through a mangle (5) to remove excess fluid and then onto a stationary drier (6) before the dried pre-treated fabric (10) is rolled (7) for storage/dispatch. The drier, known as a stenter, is a large, stationary machine through which fabric (10) is continually passed. The slow warm-up and cool-down times of the stenter mean that the stenter is generally used in a steady state operation. Generally speaking, once the stenter is turned on, it is left on for hours, if not days. When a hot stenter is eventually turned off, fabric (10) must be continually moved through the stenter while the stenter is cooling because any fabric (10) that is stationary in the stenter may become scorched. This inability to quickly vary stenter conditions means that the stenter is inflexible and leads to processing of large batches of pre-treated fabric.

Each time the fabric (10) is manipulated or, in the least, in contact with another surface, the fabric (10) suffers localised damage. The localised damage results in the generation of lint (8) as shown in FIG. 2. If the lint (8) is present on a pre-treated fabric (10) prior to printing but is then removed during subsequent process stages, any areas containing the lint particles (8) having ink embedded thereon can result in patches void of ink (9) as the lint (8) flakes off. This effect also occurs due to the presence of dust or any other loose material on the surface of the pre-treated fabric. The consequence of lint and/or dust (8) present on a fabric (10) prior to printing is that the final finish quality is inferior due to the loss of ink (9) and the patchy finish.

When printing onto a pre-treated fabric by inkjet, the fabric is first treated as described and is then supplied in roll form to the printer. Normally, the two processes of pre-treatment and printing are separate (i.e. offline) because, unlike the pre-treatment process which feeds the fabric continuously, the nature of the inkjet printing process means that the fabric movement is intermittent. The current solution is therefore to supply individual printers with the specifically pre-treated roll of fabric. It is currently impractical to use the known systems to produce a continuous sheet of fabric that comprises different runs of chemical pre-treatment. The known pre-treatment system cannot easily stop and start because the down time between changes in line process conditions is too long. The known pre-treatment system is inflexible and lacks transient control (i.e. cannot quickly respond to changes in system setup). Typically, during the ink transfer stage, the pre-treated fabric is held still. This allows the inkjet heads to move across the width of the fabric and propel ink onto the fabric. Once a row or pass of ink has embedded onto the fabric, the fabric moves forward until the process starts again. This stepwise printing motion is different to the continuous motion on the pre-treatment process. Achieving compatibility between the two processes poses a challenge. Generally, the wider the roll of fabric, the longer the fabric must be held in position because the speed of the side-to-side movement of the inkjet head is fixed. If the fabric is held stationary in the stationary drier for too long, the fabric would begin to suffer thermal damage by scorching.

It is therefore an object of the present disclosure to improve the way fabric is pre-treated and printed by inkjet. It is desirable to provide a spray treatment solution that allows integration of the pre-treatment and printing processes. Nevertheless, advantages of the spray treatment herein described give rise to costs savings allowing the system to be used in other applications as well as, primarily, for integration with a digital printer. It is further desirable to limit the presence of dust or the generation of lint during the pre-treatment and/or printing process. One general aim is to provide more customization and better control. A further general aim is to reduce the complexity of the working processes. Although the application has been described in relation to pre-treatment for ink jet printing, it will be appreciated that the solution can be used in the treatment of fabric in other situations, and particularly to replace the use of other padding and stenter processes.

Various parts of the pre-treatment and printing process require the fabric to be coated with liquid, for instance pre-treatment chemicals. Here, it is important that an even distribution is achieved as otherwise defects can be seen in the finished fabric.

It is therefore a further aim to achieve a uniform coating process on fabric that is integratable with the incremental fabric travel of an ink jet printing process.

SUMMARY

According to the present invention there is provided an apparatus and method as set forth in the appended claims.

Other features of the invention will be apparent from the dependent claims, and the description which follows.

A method of coating a substrate with fluid is provided. The method comprises spraying the fluid through one or more nozzles that are each arranged to create an uneven density of fluid in a spray zone. A first nozzle is moved relative to the substrate to make an elongate first spray zone with the uneven density across the elongate direction. Multiple spray zones are created by successively moving the nozzle or a second nozzle across the fabric wherein each spray zone at least partially overlaps another spray zone and wherein the overlapping of the spray zones causes an even density of fluid to be deposited on the substrate.

The substrate is suitably a flexible substrate able to be wound and unwound through a coating machine. For instance, card or corrugated card that requires coating. However, the substrate is suitably envisaged as being a fabric.

In one exemplary embodiment, the unevenness of fluid density across the nozzle movement direction is created by oscillating the nozzle in a swinging motion as the nozzle traverses the substrate. The oscillating direction being different to the nozzle movement direction. Specifically, the oscillating motion is caused by angular rotation of the or each nozzle about an axis. Suitably the axis is parallel to the substrate. Importantly, the fluid density is heaviest in the centre of the oscillation as opposed to the two extremes of the swinging motion. In an alternative exemplary embodiment, the unevenness of fluid density across the nozzle movement direction is created by angling a principal emitting direction of the nozzle to the vertical. Here, the trajectory of the principal fluid droplets emitted from the nozzle is angled to the vertical, which cause an uneven distribution with a heavy density nearest the nozzle and a lightest density furthest from the nozzle. When the nozzle is angled to obtain the uneven density, the nozzle is oscillated in a vibratory motion that acts to break up the droplet pattern. Preferably, the nozzle is oscillated in a vibratory motion across the traverse direction.

According to an exemplary embodiment, a treatment station for impregnating fabric, suitably with a treatment chemical, such as a pre-treatment chemical, is provided. The treatment station comprises one or more nozzles having an outlet, wherein the nozzle is supported by a treatment support and arranged to spray treatment chemical fluid under pressure through the outlet and towards a fabric. It will be appreciated that the chemical fluid may be a mixture of chemicals or a chemical solution as required in the art. The treatment support may be a frame. The extent of the spray defines a spraying zone, such that when fabric is present within the spraying zone, the fabric is coated by the sprayed treatment chemical. Typically, the chemical fluid is impregnated into the fabric. Furthermore, the nozzle is configured to move in a predetermined way with respect to the treatment support. For example, the nozzle may pivot about an axis or move along a predetermined path. The predetermined path allows the spraying zone to span and successively impregnate a width of the fabric with the treatment chemical fluid. Advantageously, the spraying of chemical fluid allows the treatment of fabric to be better controlled, such that operating parameters (e.g. duration of nozzle opening, volume and/or pressure of fluid, distance to fabric) can be varied.

Exemplary embodiments thereby provide a spray treatment station or apparatus as herein described.

Preferably, the treatment station is arranged to control a penetration distance of the treatment chemical fluid through the fabric so that the penetration distance can be reproducibly varied as required. The penetration distance is the maximum distance that the treatment chemical passes (i.e. absorbs) into the fabric from the surface of the fabric that is exposed to the spray. At least 10% of the chemical may reach about 90% of this distance. This penetration distance may be controlled by varying the duration, pressure, temperature, viscosity or volume of spray on a fabric, for example. The treatment station improves the repeatability of the treatment process whilst introducing a configurable aspect to the treatment station. The penetration distance may be controlled by spraying the treatment chemical fluid onto one side of the fabric only. Alternatively, the pre-treatment station may include first and second nozzles arranged on opposed sides of the fabric and so as to coat both sides of the fabric. The controlled exposure of the fabric to the treatment chemical improves the repeatability and prevents the fabric from being drenched by treatment chemical. This reduces waste of the treatment chemical fluid, and helps to reduce the required drying times of the treated fabric so that production runs are quicker. Preferably, the penetration distance can be controlled between a depth of around 10% to around 90% of the thickness of the fabric. That is, the maximum extent of the treatment chemical may pass anywhere between 10% and 90% of a fabric's thickness. The penetration distance may be predetermined so that it is repeatable.

Preferably, the treatment station comprises a plurality of nozzles. The plurality of nozzles may operate simultaneously. However, preferably the plurality of nozzles are individually controllable in order to provide optimisation. At least one of the plurality of nozzles may be configured to spray a different treatment chemical fluid from another one of the plurality of nozzles. This allows the concurrent treatment of different chemicals or the successive treatment of the different chemicals. For example, some nozzles may be used for a different production run.

According to an exemplary embodiment a method of spray coating a fabric comprises causing at least one spray nozzle to oscillate in a first direction of the fabric being coated whilst simultaneously traversing at least partially across a second direction of the fabric in order to spray a first pass of liquid on the fabric. The spray emitter or a further spray emitter forming a second and subsequent pass that is off-set from the first and each subsequent pass respectively. The second and each subsequent pass causes overlapping of the sprayed material at the edges, thereby providing an improved distribution of the spray coating. Moreover, because the spray coating is incremental, the method is easily adaptable to integrate with an ink jet printing process.

In the exemplary embodiments a fluid is spray coated. The spray nozzle is designed to emit a spray of fluid droplets to coat the material. For instance, suitably, the nozzle is an atomising nozzle that emits fine droplets of liquid. The method comprises causing fluid to be emitted whilst the nozzle is simultaneously oscillating and traversing the fabric. Suitably, the oscillation direction is angled to the traversing direction, for instance the oscillating direction may be angled at more than 45° or more than 60° to the traversing direction. More preferably, the oscillating direction is angled perpendicularly to the traversing direction.

In the exemplary embodiments, the successive steps are formed along a length direction of the fabric. Here, the traverse direction is suitably across a width of the fabric, perpendicular to the length of the fabric. However, the traverse direction may also be angled to the length direction of the fabric. The traverse direction may change after traversing at least part of a full traverse from one edge of the fabric to another. Alternatively, if only a part of the fabric is being coated, the full traverse may be arranged to be from one edge of the area to another.

The traverse may be caused to be linear over at least part of the extent of traverse of the at least one nozzle.

At least two nozzles may be provided each of which is arranged to partially traverse a length of fabric and each causing fluid to be emitted thereby coating the fabric and each being able to oscillate whilst fluid is emitted with the traverse of each nozzle causing fluid to be emitted at a common region and with the traverse of the one nozzle coating to one side of the common region and with the traverse of the other nozzle printing to the other side of the common region. The partial traverse of the nozzles from the common region towards the respective sides of the common region may be caused to have an inclusive angle of less than 180°.

In the exemplary embodiments, the method comprises causing coating onto the fabric with the at least one nozzle and then causing relative movement of the fabric and the nozzle before then causing a further traverse of the nozzle and further simultaneous oscillation of the nozzle with there being a partial overlap of coating between successive printing onto the fabric. The oscillation of the nozzle causes the coating pattern on the fabric to have a wider width than a fixed nozzle. Moreover, it has been found that by unevenly coating the fabric in the oscillating direction such that the centre area has a higher density of coating, and then overlapping the second and subsequent passes, a more even distribution of fluid coats the surface. In particular, it has been found that when spray coating using a fixed nozzle that is traversed across the fabric and laying subsequent passes to lie exactly adjacent to the first, although a uniform distribution across each pass is achievable by appropriate nozzle design, at the edges, manufacturing tolerances mean gaps or double coated areas can be formed. For instance it has been found that if successive print lines are made, one next to the other, there can be a portion that is not fully covered by each cross movement of the printer or that is covered more densely leading to an uneven application of the fluid. This can result in bands of light area printing appearing on the fabric where the printing should be of uniform colour.

The method may comprise causing at least part of the traverse to be in a direction perpendicular to the length of the fabric over at least part of the traverse.

The method may comprise varying the amount of fluid being emitted during different parts of the oscillation movement.

The method may comprise causing fluid to be emitted in a first direction of traverse movement of a nozzle and then in a successive pass causing fluid to be emitted in a second direction of traverse opposed to the first direction.

The method may comprise varying the extent of oscillation of the nozzle. For instance, the method may comprise causing the extent of the swinging oscillation to be more than 5°. The method may comprise causing the extent of the swinging oscillation to be less than 60°.

The method may comprise varying the frequency of oscillation.

The method may comprise varying the speed of movement in the traverse direction.

The method may comprise varying the rate of fluid being emitted from the nozzle.

The method may comprise varying the distance between the fabric and the nozzle.

According to an exemplary embodiment a spray coating apparatus is arranged, in use, to coat onto fabric. The spray coating apparatus comprising a carriage carrying an nozzle the carriage being arranged, in use, to carry the nozzle at least partially traverse to a first direction of fabric with the nozzle emitting a spray of fluid onto the fabric whilst being carried by the carriage and an oscillator arranged, in use, to cause the nozzle to be simultaneously oscillated whilst the nozzle traverses the fabric. In the exemplary embodiments, the oscillator is arranged to vary the angular movement of the nozzle about a pivot point periodically, for instance in a sinusoidal function between two extents of oscillation to produce a swinging motion or in a short back and forth vibratory motion. Suitably, when swinging, the centre of the periodic oscillation arranges the nozzle in a vertical orientation. Alternatively, when vibrating, the centre of the oscillation may be arranged at an angle to the vertical, for instance around 45° to the vertical or between 40° and 50° or greater than 30° or less than 60°. Suitably, the angle of the nozzle is controllable to allow different oscillating extents and different primary direction angles of the nozzle relative to the vertical as centre points for the oscillation.

The carriage may be arranged to carry the nozzle in a traverse direction at an angle to the perpendicular of the length of the fabric along at least part of the traverse.

The carriage may be arranged to carry the nozzle in a linear direction in at least part of the traverse.

At least two nozzles may be provided each carried by their own carriage, each carriage being arranged to cause each nozzle to at least partially traverse a direction of fabric and each including an oscillator. Each carriage being arranged to cause fluid to be emitted at a region common to both nozzles with one carriage being arranged to move towards one side away from the common region and the other carriage being arranged to move away from the common region towards the other side.

A driver may be provided arranged, in use, to cause relative movement of a fabric and at least one carriage in the lengthwise direction of the fabric.

A controller may be provided arranged, in use, to control any one or more of the extent of oscillation of the oscillator, the frequency of oscillation of the oscillator, the speed of movement of the carriage, the rate of fluid being emitted by the nozzles, the temperature and/or viscosity of the fluid, or the distance between the nozzles and a fabric.

In one embodiment, the oscillating nozzle is achieved through the nozzle being pivotally mounted. The oscillator may include a reciprocating lever connected to the nozzle at a location spaced from the pivotal connection of the nozzle.

The reciprocating lever may be pivotally mounted on the nozzle and the lever, in use, is caused to reciprocate by a further lever pivotally connected to the reciprocating lever, the further lever also being pivotally connected to a rotating member at a distance from the pivotal connection of the rotating member.

The rotating member may be caused, in use, to rotate by frictionally engaging a belt of the carriage, which belt effects the traverse movement of the nozzle.

A motor, for instance a stepper motor, may be provided arranged, in use, to cause the nozzle to rotate about a pivot, said rotation providing the primary nozzle direction and the oscillation by angular turn to either side of the primary direction.

In an alternative embodiment, the oscillating nozzle is achieved through the nozzle being pivotally mounted. For instance, a pivoting axis that is arranged parallel to the substrate, and suitably a pivoting axis that is parallel and arranged in a direction across the substrate. Instead of driving the nozzle to rotate by directly fixing the nozzle to a stepper motor or the like, or by mechanically connecting the nozzle to a driving belt or the like, both of which can cause a dwell time or delay at the change in direction, in the alternative embodiment, the oscillation is caused by oscillating a bobbin by electromagnetic attraction. Suitably the bobbin is suspended between a fist and second electromagnet. Suitably a yoke arm connects the bobbin to the nozzle, wherein movement of the bobbin in a back and forth motion between the electromagnets is transferred in to oscillating motion of the nozzle. In the exemplary embodiment, the nozzle is mounted on a vibration mount, wherein the vibration mount provides a damping force resisting movement by urging the nozzle back to a centre point. Advantageously, by using a bobbin oscillated between first and second magnets that are controlled to turn on and off to attract or not the bobbin, the oscillation parameters of the nozzle can be easily changed without a change to the mechanical set-up. Moreover, by appropriate setting and use of the vibration mount, the dwell time or delay at the change in direction can be reduced.

According to another exemplary embodiment, a method of treating a substrate such as fabric, includes spray coating onto fabric as previously defined wherein the fabric has been treated by a drying station as herein defined or by a treatment station as herein defined or by a method of treating fabric as herein defined. For instance, the apparatus may be an integrated apparatus incorporating two or more processing stations, wherein the substrate is arranged to move through the apparatus and through each station in an incremental step-wise fashion. That is, the fabric is moved forward a defined distance, held stationary whilst each station operates and then increments forward so that the entire length of the fabric is processed.

According to another exemplary embodiment an apparatus is provided having a spray coating station as previously defined and a drying station as herein defined and/or a treatment station as herein described.

According to an exemplary embodiment, a drying station for drying a coated substrate such as a fabric is provided. Suitably, the fabric being dried is impregnated with a chemical solution, for instance using the method and spray coating station as herein described. The drying station includes an emitter supported by a drying support. The drying support may be a frame. The emitter is arranged to transfer thermal energy through the emission of infrared radiation. In some examples, the emitter comprises a tungsten lamp. The extent of the infrared radiation defines a drying zone, such that fabric present within the drying zone receives thermal energy from the infrared radiation. Advantageously, the radiant heating of the fabric allows the fabric to dry in an expedient manner. Furthermore, the emitter is configured to move in a predetermined way with respect to the drying support. For example, the emitter may pivot about an axis or move along a predetermined path. The predetermined movement allows the drying zone to span and successively dry a width of the fabric. When provided in roll form, the width may be a transverse direction to the roll axis. Advantageously, the moveable drying zone provides a more dynamic drying station such that the emitter is prevented from scorching the fabric. Suitably, radiant heat of at least 70 Kilowatts per square meter (commonly abbreviated $kW/m^2$) is emitted. Conveniently, the radiant heat emitted is below 320 Kilowatts per square meter. In one example, radiant heat of approximately 100 Kilowatts per square meter is emitted. The emitter may be configured to move at speeds proportional to the intensity of radiant heat or proximity to the fabric. Therefore, an improved drying station is provided.

As mentioned, the drying station may move along a predetermined path. This path may comprise at least a linear portion. The linear portion may be substantially parallel to a width of the fabric such that the emitter moves at fixed distance from the fabric. The ends of the path may deviate away from the linear portion. For example, the predetermined path may comprise an extension along which the emitter is adapted to move. The extension may be collinear with the predetermined path. The extension may comprise a linear or non-linear portion. Alternatively, the extension may be configured such that the emitter moves away from the plane through which the surface of the fabric extends. This helps to reduce the footprint of the extensions and reduce the transverse extent of the emitter movement. The extension may be configured such that when fabric is present within the predetermined path, the drying zone is moveable away from the fabric in order to prevent infrared radiation being directed towards the fabric. Advantageously, the extensions allow the emitter to remain switched on without impacting the fabric itself. Even if the emitter is switched on and held stationary along the extensions, the fabric can be held stationary without being scorched. The emitter may continuously move along the extensions.

According to an exemplary embodiment, an apparatus for treating a substrate such as a fabric is provided. The apparatus includes a treatment station and a drying station as described. The apparatus may be arranged such that a fabric treated with a chemical fluid in the treatment station is then passed on to the drying station such that the treatment and drying mechanisms operate together.

The apparatus may further include a cleaning station configured to remove loose debris from the fabric such as dust or lint caused by manipulation of the fabric. The cleaning station may comprise an adhesive roller to clean the fabric surface by drawing debris from the surface of the fabric.

Preferably, the apparatus further comprises a motion converter, such as a dancing roller, which is a term of art. The motion converter may be arranged between the cleaning station and the treatment station such that the motion converter is configured to receive fabric from the cleaning station and convert the continuous motion of the fabric into intermittent motion. This allows the fabric ahead of the motion converter to be held stationary in cycles. Although it is preferable that the motion converter is disposed between the cleaning station and treatment station, the motion convertor may be disposed between the treatment station and drying station. In the latter instance, the fabric may pass through the cleaning and treatment stations at the same, continuous speed. Furthermore, the motion converter may be positioned after the drying station. When the motion converter is positioned between the cleaning and treatment stations, the treatment station may be arranged to spray a treatment chemical onto a fabric when the fabric is held stationary in the treatment station. This allows the spraying zone to traverse the fabric such that a width of the fabric is not treated at the same time. This allows width wise portions of fabric to be successively treated.

Preferably, the apparatus comprises a printing station. The printing station may be positioned after the drying station. The printing station may comprise an inkjet printer such that the printing station is an inkjet printing station. The inkjet printing station may be arranged to receive fabric from the drying station and to transfer ink onto the fabric. The transfer of ink may be provided when the fabric is substantially stationary. Therefore, the inkjet printer may traverse the fabric in stages.

Preferably, the stations are provided inline. That is, a station may interact with at least one other station. For example, each station may be arranged to automatically send fabric to an adjacent station and/or may be arranged to automatically receive fabric from an adjacent station without manual intervention.

Preferably, the treatment station and drying station are arranged such that the spraying zone of the treatment station and the drying zone of the drying station are moveable relative with respect to each other. Advantageously, the stations can operate at different rates and are independently configurable. Preferably, the spraying zone and/or drying zone can be moved outside of an area or region defined between the edges of the fabric, i.e. the width wise edges. This allows the spraying zone and/or drying zone to remain switched on while the fabric is moved into the next position. Additionally or alternatively, a plurality of rollers may be arranged to support the fabric outside of the spraying zone such that the fabric is unsupported in the spraying zone. Advantageously, fabric distortion or stretching is prevented because rollers are not present in the spraying zone.

According to an exemplary embodiment, a method for treating a substrate such as a fabric is provided. The method includes the steps of transferring a treatment chemical on to a fabric within a spraying zone of a treatment station of the sort as previously described. Once the treatment chemical has been sprayed on the fabric, the method further includes moving the fabric from the treatment station to a drying station of the sort as previously described. The movement may be automatic, i.e. machine activated and controlled. The fabric is then dried in a drying zone of the drying station such that thermal energy causes heating of the fabric and the chemical is absorbed and dried into the fabric. Finally, the fabric is output so that the fabric can be provided in a roll form for storage or transport. Advantageously, the moveable spraying zone and drying zone can work across a width of the fabric whilst the fabric is held stationary.

The method may include preliminary steps, i.e. steps which occur before the treatment zone. These steps may include inputting the fabric into a cleaning station. The fabric may be provided in roll form in the cleaning station. The cleaning station may be provided to remove loose debris from the fabric such as dust or lint accumulated on the fabric. The preliminary steps may further include moving the fabric in a continuous motion through the cleaning station. The fabric may then be passed onto the treatment station. The continuous movement between the cleaning station and the treatment station may be controlled by a motion converter, such as a dancing roller (a term of art). The motion converter may be configured to receive the fabric from the cleaning station and convert the continuous motion of the fabric into intermittent motion, wherein the fabric ahead of the motion converter is held stationary in cycles by movement of the motion converter. In effect, the motion converter provides cyclical movement of the fabric ahead of the motion converter. The motion converter may be provided at any location after the cleaning station but before an inkjet printing station when one is used.

Furthermore, the method may comprise the step of moving the fabric from the drying station to an inkjet printing station, wherein the fabric present within a printing zone of the inkjet printing station receives ink from the inkjet printer. That is, ink is transferred onto the fabric. Once the fabric has been printed on the fabric is output for subsequent processing, storage or transport. When a motion converter is used before the inkjet printing station, the fabric movement can be become intermittent such that the inkjet printer can print onto the fabric in stages. The stop-start nature of the fabric movement is advantageous because the process of working on the fabric is more configurable and repeatable. This provides a user with greater flexibility and control. Finally, the stations of the method may be provided inline, such that each station automatically sends fabric to an adjacent station and/or automatically receives fabric from an adjacent station without manual intervention. The inkjet printing station can therefore be integrated with the cleaning, treatment and/or drying stations so that the fabric is continually worked on. This helps to speed up processing times and reduce downtime. The inline printing of fabric also avoids the risk of damage to the fabric when temporarily stored after being dried.

Advantageously, the treatment and drying stations reduce the fabric's contact with the rollers and other fabric handling systems, which reduces the contamination of the fabric.

BRIEF DESCRIPTION OF DRAWINGS

For a better understanding of the invention, and to show how embodiments of the same may be carried into effect, reference will now be made, by way of example, to the accompanying diagrammatic drawings in which.

DETAILED DESCRIPTION OF THE INVENTION

Figure 1:
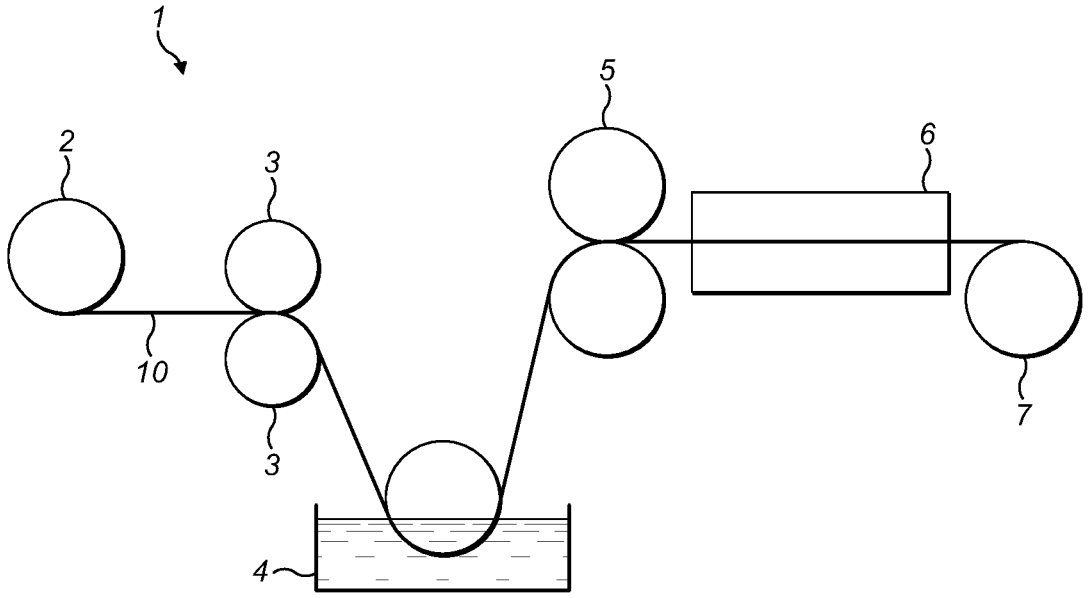
FIG. 1 Prior Art
FIG. 1 shows a known apparatus of pre-treating fabric prior to printing.
Figure 2:
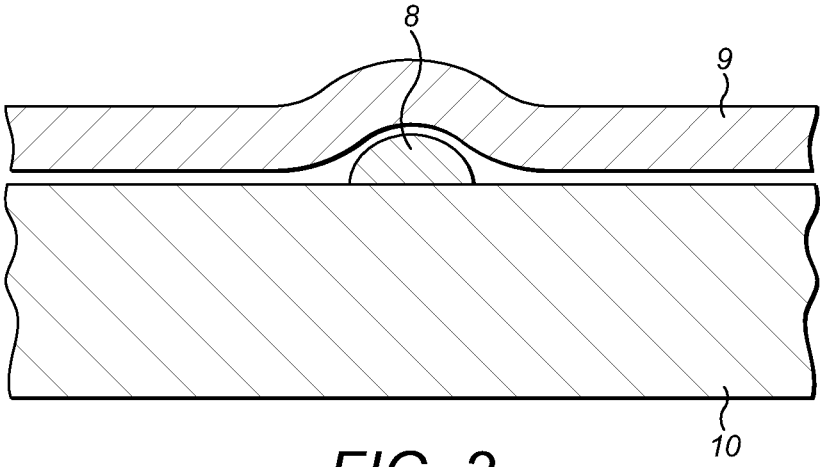
FIG. 2 shows a representation of lint or dust trapped between the ink and fabric layers.
Figure 3:
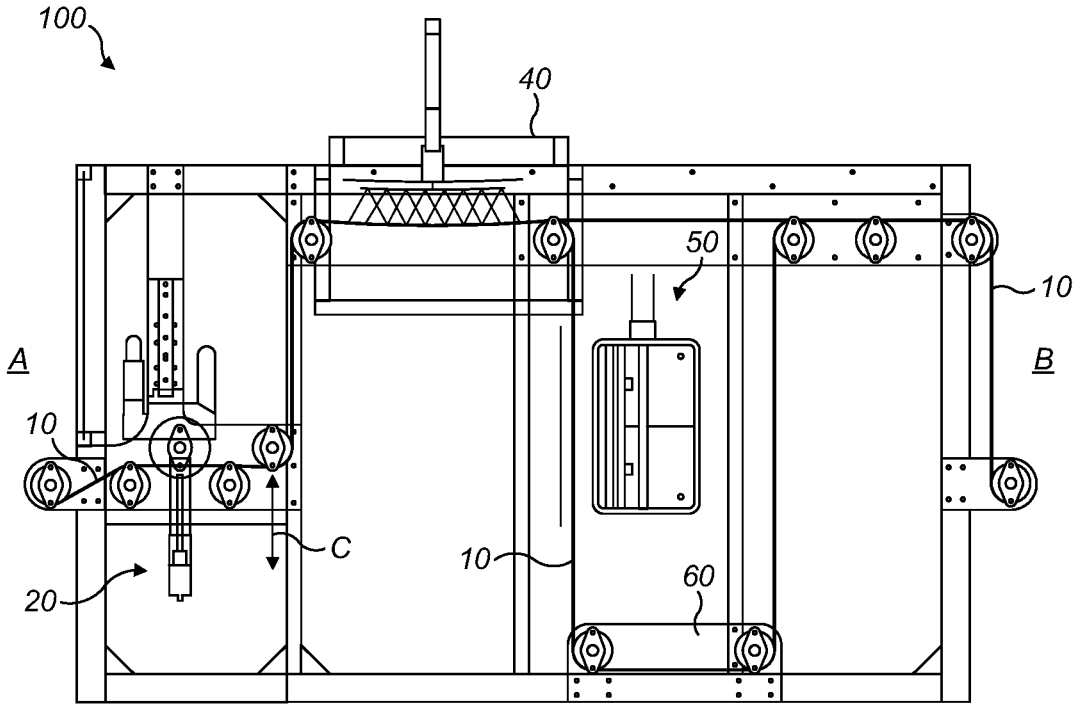
FIG. 3 shows a side view of an apparatus for treating and printing on fabric.
Figure 5:
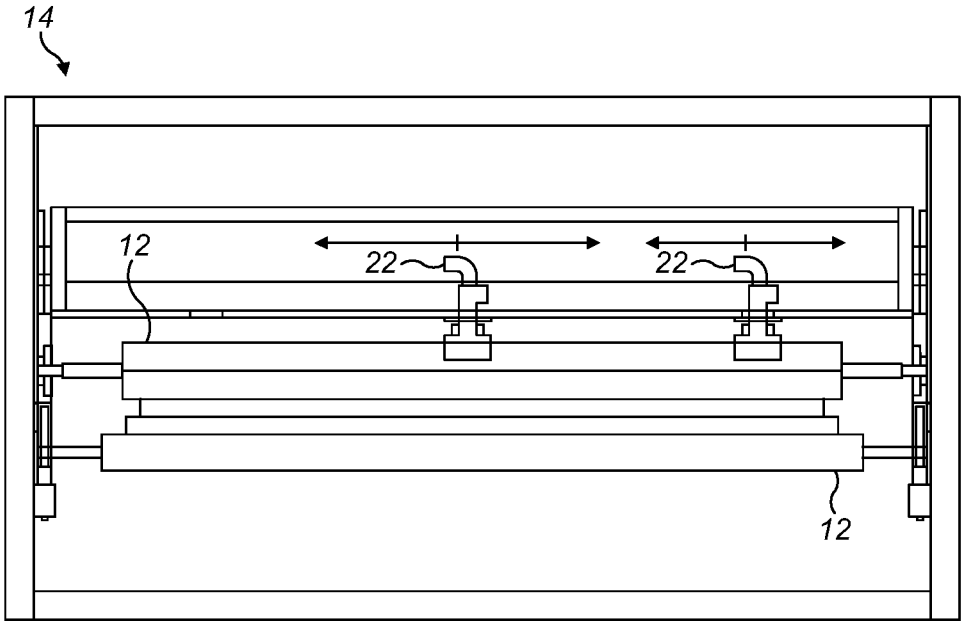
Figure 8:
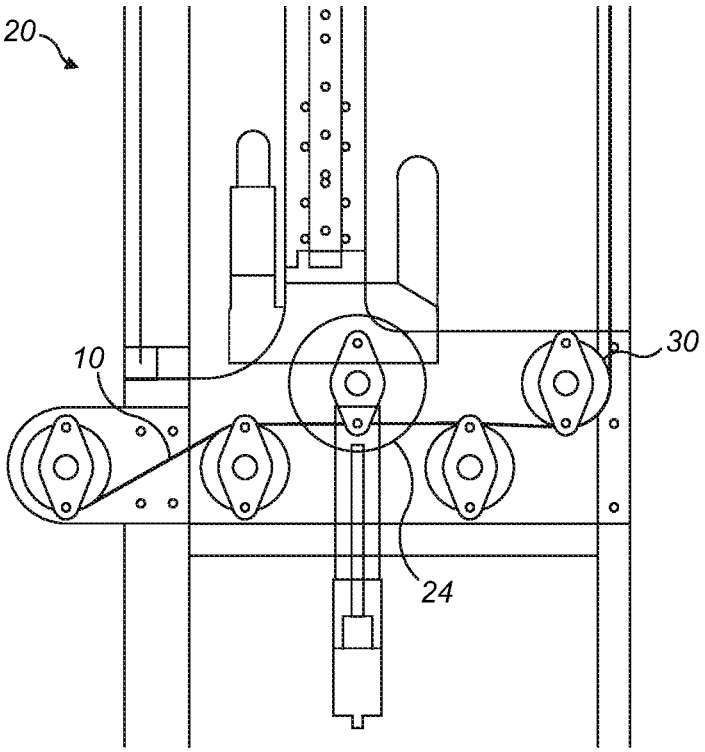
FIG. 8 shows a cleaning station.

FIG. 3 shows a side view of a fabric treatment apparatus (100). Fabric (10) is fed (preferably as a roll) into a cleaning station (20) provided at the input end (A) of the apparatus (100). The cleaning station (20), as shown more clearly in FIG. 8, comprises air suction units incorporating a high pressure water supply and an adhesive coated roller (24) that removes lint or loose debris such as dust from the fabric. Air suction units (22) operate by vacuum effect to clean the adhesive roller and detach the loose material temporarily adhered to the roller (24) as the roller (24) rotatably contacts the fabric (10). The air suction units (22) remove the loose debris from the roller (24) so that the roller (24) can continue to effectively adhere debris from the fabric (10). The suction units (22) move along the roller (24) in a traverse direction to the direction of fabric (10) movement as shown in FIG. 5. The air suction units (22) therefore move in an axial direction parallel to the longitudinal axis of the roller (24) and effectively sweep the rollers (24) as they go. Preferably, the movement of the fabric (10) through the cleaning station (20) is substantially constant or is at least continuous so that no breaks in fabric (10) movement occur. This allows the fabric (10) to be continually fed through the system (100) without interruption. However, in alternative embodiments, the roller is cleaned off-line.

Figure 9A:
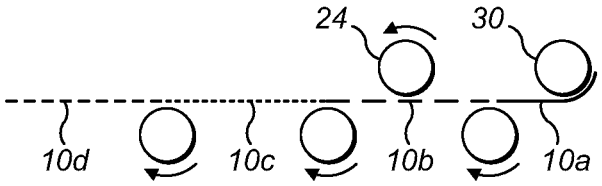
FIG. 9*a*, FIG. 9*b*, FIG. 9*c*, and FIG. 9*d* each show the operation of a dancing roller.
Figure 9B:
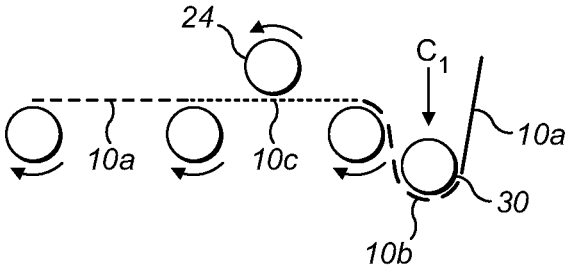
Figure 9C:
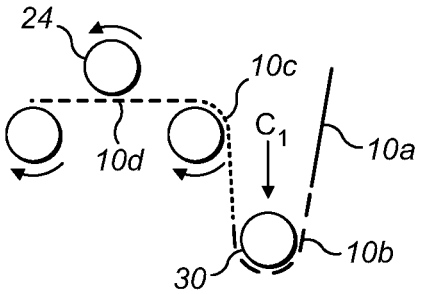

Once the fabric (10) has been cleaned, the fabric (10) is fed towards a dancing roller (30), the function of which is more clearly shown in FIGS. 9*a* to 9*c*. The dancing roller (30) converts the continuous motion of the fabric (10) exiting the cleaning station (20) into intermittent motion for supply to the rest of the apparatus (100). This allows the treatment process to be integrated as one with a printing process comprising an inkjet printer. The dancing roller (also known as an accumulator) is a term of the art and its general operation and effect is known. However, the operation in this current disclosure is briefly described in FIGS. 9*a* to 9*c*.

Figure 9D:
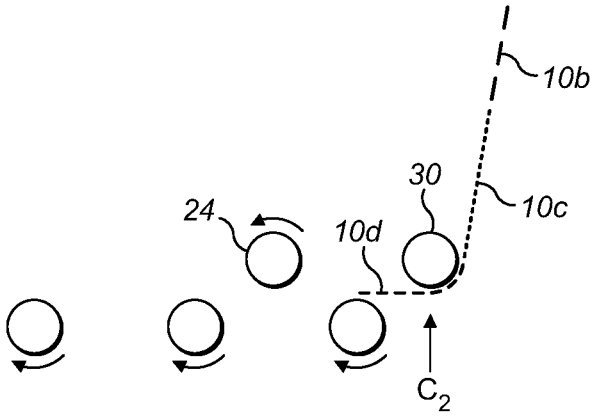

FIGS. 9*a* to 9*c* show the dancing roller (30) in operation. Fabric (10) is divided into four lengths (10*a*,10*b*,10*c*,10*d*). Each length represents a time block of unity and is therefore equal in length when a constant feeding speed is used. The dancing roller (30) has a displaceable axis so that the dancing roller (30) axis moves with respect to the axes of the cleaning rollers. As the fabric (10) is fed towards the dancing roller (30), the dancing roller (30) moves away from adjacent rollers in a downward direction (C1) as shown in FIG. 9*b*. The downward motion is simultaneous with the feeding motion and preferably operates at the same velocity. This allows one end of the first length of fabric (10*a*) to remain effectively stationary. As shown in FIG. 9*c*, the dancing roller (30) continues to move downwards as more fabric (10) is fed from the adjacent roller. This ensures that the fabric (10) does not slacken. Once three time periods have elapsed, the dancing roller (30) returns to the initial position in an upward direction (C2) as shown in FIG. 9*d*. This allows the three lengths of fabric (10*a*,10*b*,10*c*) to be fed towards the next station. Advantageously, the dancing roller (30) converts continuous motion to intermittent motion so that an inkjet printer can be integrated with a pre-treatment station (20).

Figure 4:
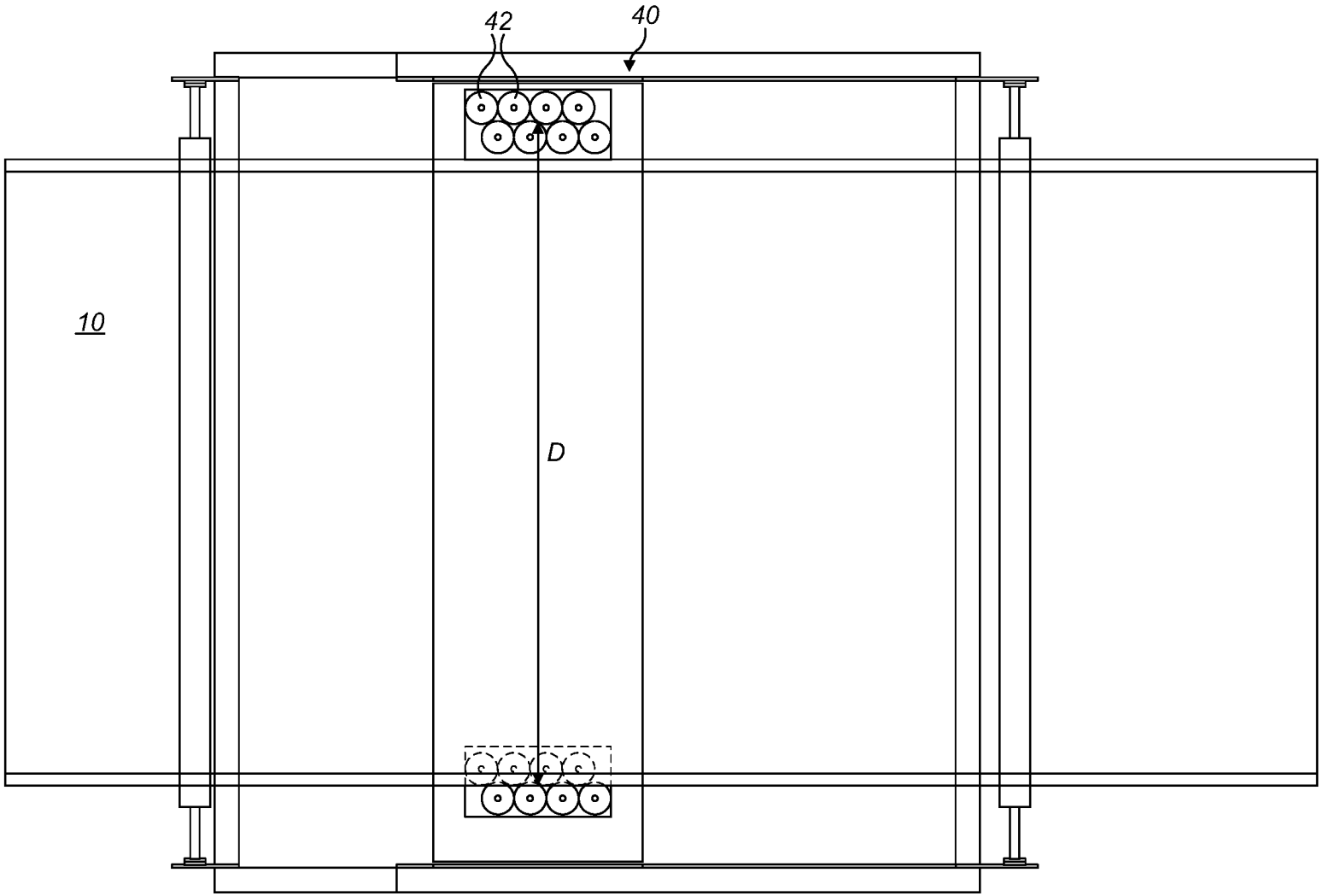
FIGS. 4, 5 and 6 show top, front and back views of the apparatus of FIG. 3, respectively.
Figure 10:
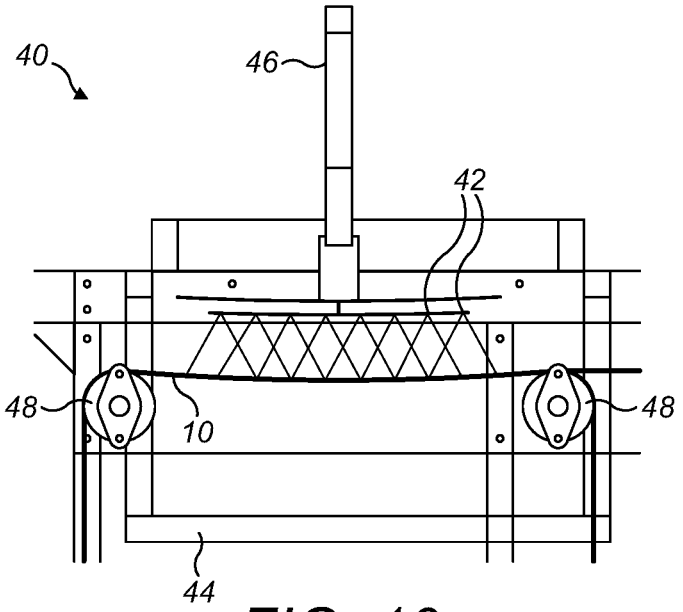
FIG. 10 shows a treatment spraying station.

Referring back to FIG. 3, once the fabric (10) leaves the dancing roller (30) the fabric (10) is sent to the treatment station (40). The treatment station (40), as shown more clearly in FIG. 10, comprises a moveable treatment zone (i.e. a spraying zone) is delineated by the extent of fluid spraying by the nozzles (42) on to the fabric (10). The spraying zone moves by an arm (46) in a transverse direction (D) across the width of the fabric (10), as shown in FIG. 4. Here, the nozzles (42) spray fluid, i.e. pre-treatment chemicals onto one side of the fabric (10) only (i.e. the top side), while moving back and forth in a direction orthogonal to the direction of fabric (10) movement through the apparatus (100). A mechanical atomisation nozzle may be used which avoids the use of air. This allows smaller droplets to be sprayed towards the fabric (10) so that a consistent distribution of treatment fluid is transferred onto the fabric (10). During the fluid spraying stage, the fabric is held substantially constant due to the movement of the dancing roller (30) even though the fabric (10) is continuously fed through the cleaning station (20).

The spraying zone is arranged such that the fabric (10) in contact with rollers (48) is not sprayed onto because contact with the rollers (48) can affect the integrity of the fabric (10) causing localised deformation compared to regions not in contact with the rollers (48). Therefore, only the unsupported fabric (10) is sprayed. That is, the spraying zone is arranged to act on an area between two supporting rollers. The duration, flow rate, pressure, volume, and average droplet size distance of the spray can be controlled in order to intimately affect the transfer or pre-treatment chemical to the fabric (10). For example, a pressure of between 50-100 bar can be used with or without a mechanical atomisation nozzle. However a pressure of between 20 and 45 bar has been found to work well and in particular around 30-35 bar. A high velocity spray may be used. The spray may be provided as a fine mist of vapour. Therefore, the penetration distance into the fabric (10) from one side of the fabric (10) can be varied. For example, a penetration level between 50-75% can be easily achieved. To prevent the spread of any excess fluid, a barrier (44) is placed below the fabric (10). In addition to the pre-treatment process a post-treatment process may be used. The post-treatment process may transfer chemicals onto the fabric (10) in order to make the fabric (10) water repellent.

Advantageously, the treatment station (40) has the ability to control the penetration level of the treatment fluid by, for example, varying the speed of movement, the pressure, volume, flow rate of fluid ejection and the number of nozzles. This means that there is no need for a mangle to draw excess fluid out of the fabric (10), which helps to make the apparatus (100) more compact and efficient. There is also no need to submerge the fabric (10) in a fluid bath, which improves the quality control of the fluid and avoids the need to store treatment fluid in a reservoir. Furthermore, rollers are not directly exposed to the treatment chemicals during spraying.

Figure 12:
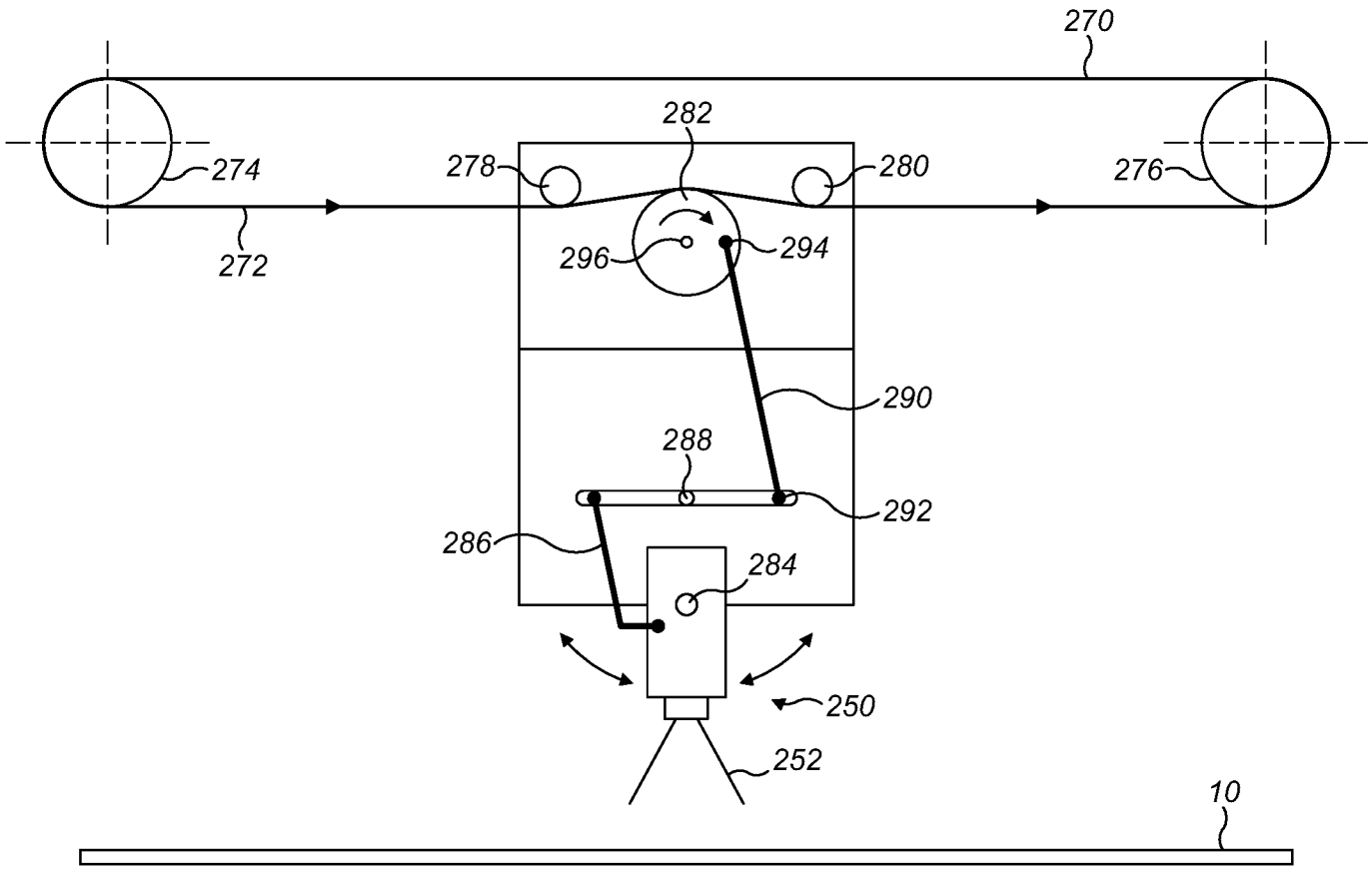
FIG. 12 is a side view of an spray coating station.

FIG. 12 shows an exemplary spray coating station (240) wherein a nozzle (250) is mounted to traverse the fabric in one direction whilst simultaneously oscillating in a back-and forth motion in a second direction. Here, the nozzle is arranged to at least partially traverses the fabric (10) to cause fluid (252) to be emitted thereby coating onto the fabric (10) through gravity. The nozzle is caused to oscillate as shown by the arrows (254) whilst fluid is being emitted. The spray zone of the nozzle is increased by the oscillation, whilst also allowing the density distribution in the oscillation direction to be unevenly distributed such that fabric under the centre of the oscillation is coated with a greater density of fluid than fabric towards the edges of the spray zone. After the nozzle has completed a traverse, the fabric is arranged to move relative to the nozzle, for instance by an increment in the length direction of the fabric. The nozzle can then make a return traverse to coat a second and subsequent spray zone on the fabric. However, the nozzle may be arranged to step along the fabric to make multiple passes, before indexing the fabric forward. Moreover, multiple nozzles may be provided and the fabric stepped a greater distance between each pass or passes of the nozzles. By overlapping the adjacent spray zones, it has been found that the unevenness of each spray zone can be compensated, and a more even complete coating achieved as compared to a non-oscillating nozzle wherein the subsequent spray zones are attempted to be laid immediately next to each other.

The nozzle (252) is selected to provide a spray of fluid having a suitable spray pattern. The nozzle may create a constant spray pattern across the projected spray area. However, it has been found that by oscillating the nozzle, the fluid distribution across the spray pattern can be varied and by overlapping subsequent spray patterns, a more even coating is achieved. The oscillation may be a swinging motion wherein the amount of fluid emitted at the centre of an oscillation is caused to be greater than the amount of fluid emitted towards the extremes of oscillation. As explained, suitably there is a partial overlap of the spray areas after an initial traverse of the nozzle with subsequent relative movement of the fabric and a further traverse of the nozzle. Consequently as the fluid emitted towards the extremes comprises an overlap of two successive traverses a more even distribution of the fluid onto the fabric may be effected.

Figure 13:
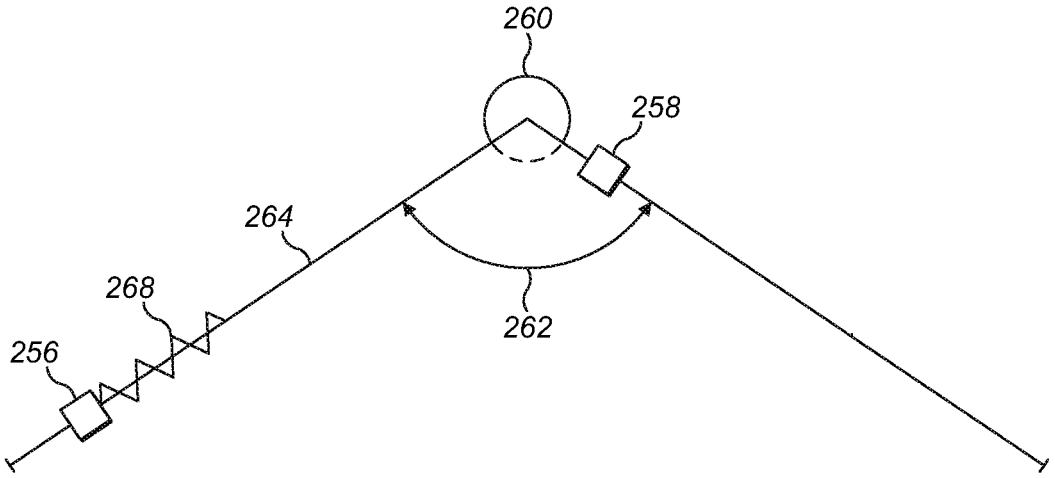
FIG. 13 is a plan view of one embodiment of a spray coating station.

Typically, the traverse is envisaged as moving in a linear direction across the fabric. When integrated with an incremental movement of fabric through an ink jet printer, the traverse would be substantially perpendicular to the lengthwise incremental movement of the fabric. Here, the nozzle is mounted on an arm or other movement means that moves a nozzle mount. However the direction of the traverse may be at an angle to the perpendicular of the length of the fabric as shown in FIG. 13, for instance. Alternatively the movement means moves the nozzle mount simultaneously in a two axis, such as the length and with axis of the fabric so that the nozzle moves in a non-linear direction.

There may be two nozzles (256, 258) each of which is able to partially traverse a length of fabric, whilst simultaneously oscillating so that fluid is oscillated unevenly across the spray zone in the oscillating direction. The two nozzles may be arranged spaced in an oscillating direction so that two overlapping spray zones are deposited in a single traverse. Here the two nozzles may be mounted on a commonnozzle mount. Alternatively, the nozzles may be arranged in line so that fluid is sprayed at a common region (260) with the traverse of one nozzle coating to one side from the common region and the traverse of the other nozzle coating to the other side. Alternatively, each nozzle of the plurality of nozzles may be arranged to coat a first respective spray zone and then to move relative to the fabric. In this instance, the nozzles are mechanically arranged to move. Subsequent to the movement, each nozzle is arranged to coat a second respective spray zone adjacent and at least partially overlapping the respective first spray zone corresponding to that nozzle. Further spray zones may be created. After which the fabric is arranged to move relative to the nozzles, Here, the first nozzle coats in two or more successive spray zones a first area, and the second and each subsequent nozzle creates a second spray area of at least first and second spray zones. The increments being such that the first and second spray areas overlap. And the fabric incrementally moves to provide an uncoated area under each spray nozzle.

As envisaged above, the multiple inline nozzles may combine to lay a linear spray zone, or, as shown in FIG. 13, the plurality of nozzles may form an inclusive angle (262) of the traverse (264) of less than 180°. The angle (262) may be more than 10° or more than 20° or more than 30° or more than 40° or less than 70° or less than 60° or less than 50°. Only one nozzle (256, 258) at a time may effect a print at the common region. Moreover, one, or more than one nozzle may move in both directions of traverse and the fabric may be moved relative to the or each nozzle after laying a coating in one direction of traverse before effecting coating in the reverse direction.

The traverse may be in a direction perpendicular to the length of the fabric over at least part of the extent of the traverse. The apparatus is suitably controllable so that the rate of traverse and rate of fluid egress from the nozzles is controllable and customisable to the fabric and fluid being coated. For instance, the method may comprise varying the amount of fluid being emitted during different parts of the oscillation. Also, the method may comprise varying the extent of the oscillation. Suitably, the method may comprise causing the extent of the swinging oscillation to be more than 5° or more than 10° or more than 20° or less than 60° or less than 50° or less than 40°. However, an oscillation having an angular movement of between 5° and 10° has been found to work well. Furthermore, the frequency of oscillation may be varied. The frequency oscillation may be between 1 Hz and 100 Hz, but a frequency of between 25 Hz and 40 Hz and in particular around 32 Hz has been found to work well. The speed of movement in the traverse direction may be varied. The rate that fluid is emitted may be varied. The distance between the fabric and the fluid nozzle may be varied.

It is envisaged the oscillation of the nozzles is achieved using a number of known techniques. For instance, each nozzle may be mounted to a nozzle mount via a pivot. A directly controlled motor could then be used to turn the nozzle to rotate through an angle to achieve the oscillation. However, preferably a periodic oscillation is required wherein the rate of angular movement has a sinusoidal function. With high precision, this is achievable with a directly controlled motor, but it has been found a more achievable system is to mechanically mount the nozzle to rotate about a pivot point through a mechanical coupling. For instance, as shown in FIG. 12 a carriage (270) may carry the nozzle and thus cause the nozzle to effect the traverse.

The carriage (270) includes an endless belt (272) looped around opposed wheels (274, 276) at least one of which is driven. The belt supports the nozzle 250 by two wheels (278, 280) that rest on the upper surface which wheels travel with the belt as the belt moves and guide the belt to drive a driving wheel 282.

The driving wheel (282), located between the wheels (278 and 280) bears against the underside of the belt and the linear direction of the belt may be deformed slightly or the belt extends under the wheels (278, 280) and over the driving wheel (282). The driving wheel (282) frictionally engages with the belt and is caused to rotate as the belt moves.

The nozzle (250) is mounted on a pivot (284). A reciprocating lever (286) is connected to the nozzle at a location spaced from the pivot (284). The lever (280) is mounted about a pivot (288). A further lever (290) is pivotally connected to the reciprocating lever as a pivot (292) spaced from the pivot (288). The further lever (290) is also connected to the driving wheel (282) at a pivot (294), radially spaced from the axis (296) of the driving wheel (282).

As the driving wheel rotates the pivot (294) moves up and down to cause the further lever (290) to move up and down. This in turn causes the lever (286) to move up and down at the pivot (292) thus causing the nozzle to oscillate.

In an alternative arrangement a motor may be directly or indirectly connected to the pivot (284) of the fluid nozzle to effect the oscillation thereof. The motor may drive the fluid nozzle in alternative directions. Thus the motor may be controlled to vary the extent of oscillation.

A controller (not shown) may control any one or more of the extent of oscillation, the frequency of oscillation, the speed of the traverse, the rate that fluid is emitted or the distance between the fluid nozzles and the fabric.

It will be appreciated that the oscillation means can be achieved in a number of ways so that the nozzle tilts about an axis, typically a horizontal axis so as to divert the spray at varying angles to the vertical and therefore achieve the uneven distribution across the spay zone.

Figure 14:
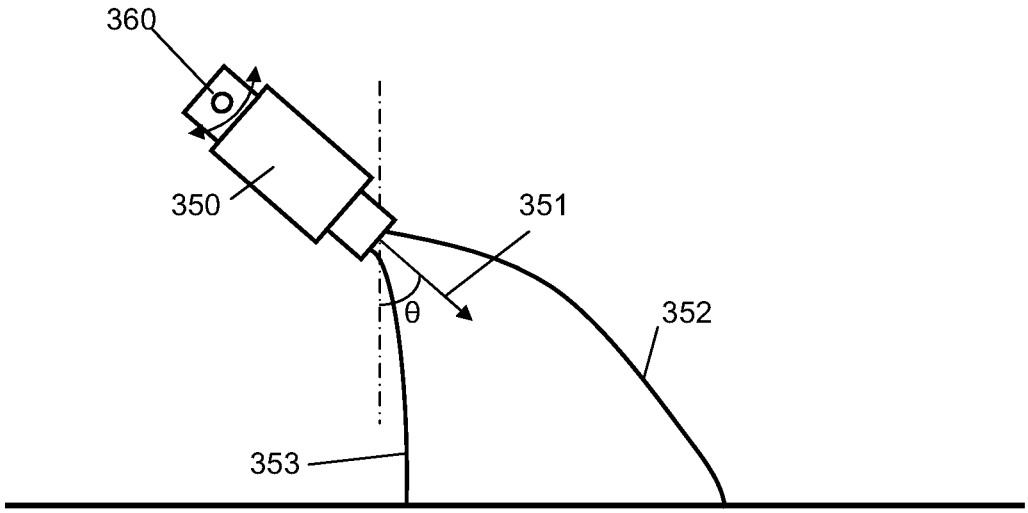
FIG. 14 is a schematic view of an alternative nozzle arrangement.

Referring to FIG. 14, a second configuration of the nozzle is shown. It will be appreciated that the machine may be configured to swap between previous swinging configuration and the second configuration and that this is particularly achievable by mounting the nozzle to the shaft of a stepper motor that can be directly controlled to rotate through angular movements.

As shown in FIG. 14, the nozzle 350 is mounted to the shaft of a motor 360. Here the motor can operate in the first configuration by swinging about a centre of oscillation, for instance the centre of oscillation is substantially vertical. Alternatively, in the second configuration, the motor rotates the nozzle to be arranged with a principal direction angled to the vertical. In FIG. 14, the principal direction is indicated by arrow 351 and is the main direction that fluid is emitted from the centre of the nozzle. The angle to the vertical is shown as angle θ. Suitably the angle θ is around 45*o*. However, alternative angles are envisaged based on optimisation for the fluid and fabric.

The angling of the nozzle, causes the spray distribution to become uneven. In FIG. 14, the two extents of the spray pattern are indicated by lines 353 and 352. Due to the gravitational effects the spray distribution of the coating is caused to be heaviest nearest the nozzle at extent 353 and lightest furthest from the nozzle at extent 352. It has been further found that by oscillating the nozzle through short angular turns, the vibration causes the droplet pattern from the nozzle to be disturbed and therefore reduce localised hotspots within the spray pattern density. Advantageously, by coating the substrate unevenly and overlapping subsequent spray zones, a more even coating can be achieved.

Figure 15:
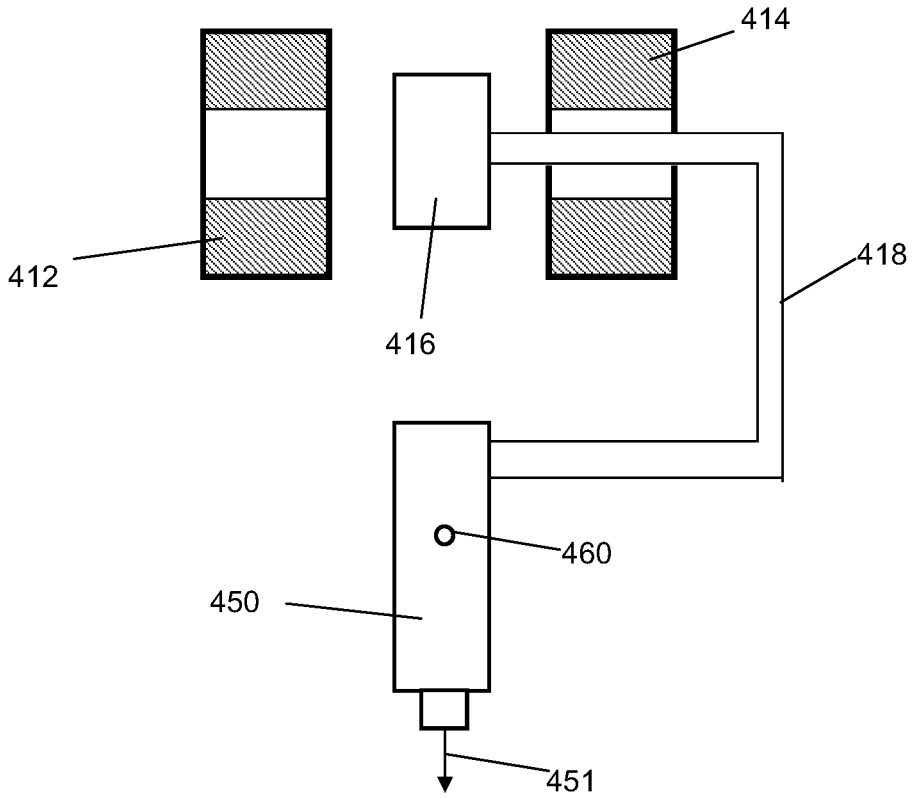
FIG. 15 is a schematic view of an alternative nozzle oscillation arrangement.

FIG. 15 shows a further configuration of the oscillation arrangement to cause the fluid nozzle 450 to oscillate, Here, a bobbin 416 is arranged in an electromagnetic system 410 that acts on the bobbin 416 to cause the bobbin to move in a side-to-side oscillating arrangement. As will be appreciated, due to the bobbin being connected at an offset pivot point (as described below) the side-to-side movement might not be a pure lateral movement, but rather a part of an arc. As shown in FIG. 15, the electromagnetic system comprises first 412 and second 414 electromagnets. Here the bobbin 416 is a fixed magnet. Consequently, by turning the respective first and second electromagnets on and off, the bobbin can be urged towards each electromagnet. By appropriate timing, the bobbin is caused to oscillate back and forth between the electromagnets. Importantly, a dwell or delay at the change in movement can be reduced by appropriate control of the timing. A yoke arm 418 connects the bobbin 416 to the fluid nozzle 450. The fluid nozzle is arranged to pivot about a pivot point 460. Suitably, the pivot is a vibration mount that resists movement by urging the nozzle back to the datum. For instance, the vibration mount is suitably a resilient material able to twist. One end of the material is fixed to the nozzle and the other end fixed to an anchor. The nozzle rotates by twisting the material. The natural resiliency of the material urges the nozzle back to the datum. The vibration mount can therefore combine with the electromagnetic forces to smooth the movement and reduce dwell or delay at the directional change.

Once the fabric (10) has been treated, the fabric (10) is intermittently fed to a drying station (50) as shown in FIG. 3. The drying station includes means for applying heat energy. In some examples, using an emitter supported by a drying support. Suitably, the emitter comprises a heating element. Conveniently, the emitter comprises a reflective backing.

In some examples, the emitter is chosen and tuned to emit radiation of certain range of wavelengths. Conveniently, the range is suitably chosen for the fabric and coating to be dried. In some examples, the emitter is arranged to emit predominantly a narrow range of wavelengths. In one example, the emitter is arranged to emit close to a single wavelength.

For example, for drying fabric, and preferably cotton, a wavelength of more than 1.3 μm (micrometres) is chosen. Preferably, a wavelength of 1.38 μm is selected. Conveniently, for drying cotton a colour temperature in a range of 2000-2200 K (Kelvin) is chosen. In some examples, the colour temperature is 2100 K.

In some examples, the emitter comprises a highly reflective backplate to increase the efficiency of the transfer of energy to the fabric. Additionally or alternatively, a highly reflective plate may be placed opposite to the emitter in a direction of emission such that, in use, fabric is located between the emitter and the highly reflective plate. Conveniently, the highly reflective plate is arranged to reflect emitted energy. Suitably, emitted energy which has passed the fabric may thereby be redirected towards the fabric.

In some examples, the drying station comprises means for transferring mass from the fabric during the drying process. Conveniently, the drying station is configured to remove fluid, preferably moisture, resulting from the drying process.

Conveniently, the amount of heat energy emitted by a drying head of the drying station is chosen for quickly drying the fabric and removing any resulting vapour. In some examples, such may be achieved within a few seconds per square meter and, in one example, one second per square meter.

Figure 11A:
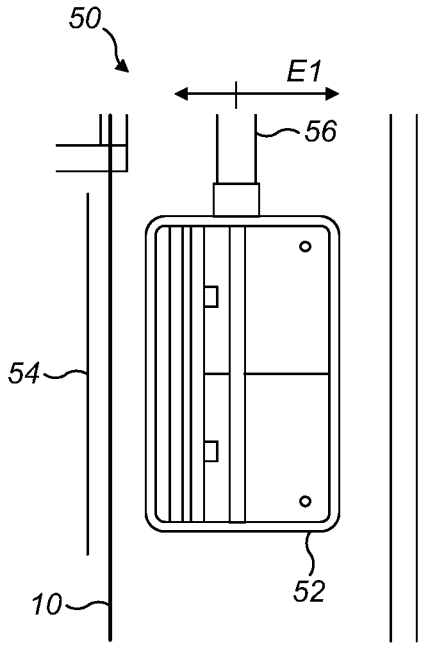
FIGS. 11*a* and 11*b* show a heating station and the movability of the heating unit.
Figure 11B:
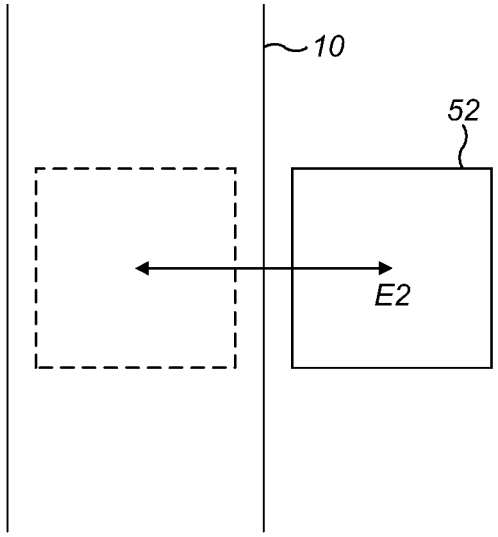

In this example, the drying station, which is more clearly shown in FIGS. 11*a* and 11*b*, comprises a moveable infrared drier (52). When in the drying position, a length of fabric (10) placed between the infrared drier (52) and a heat shield (54), such as a reflector, is heated by the thermal energy transferred by the infrared radiation. The region of thermal energy emitted from the infrared drier (52) is the drying zone. The proximity of the infrared drier (52) to the fabric can be varied in order to affect the speed of drying and/or heating. For example, a distance of between 100-200 mm can be used when the infrared drier (52) is static or a closer distance of between 25-100 mm, or preferably 10-50 mm, can be used when there is relative movement between the infrared drier (52) are the fabric (i.e. the infrared driver (52) is continuously moving). This allows the infrared drier to be close to the surface of the fabric (10) to be dried and/or heated. Advantageously, the use of an infrared drier (52) allows the drying means to be turned on and off as required because the infrared drier (52) can warm up quickly without detrimental performance effects. Furthermore, the drying zone can be well controlled. For example, the speed of the drier (52) relative to the fabric (10) can be varied as well as the distance between the drier (52) and the fabric (10).

A moveable arm (56) connected to the infrared drier (52) is configured to move relative to the fabric (10) when the fabric (10) is held in position. For example, the infrared drier (52) may move towards or away from the fabric (10) in a first direction (E1) and side-to-side in a second direction (E2), substantially orthogonal to the first direction (E1). The infrared drier (52) may move beyond the edges of the fabric (10). This helps to evenly spread the distribution of heat and avoid scorching of the fabric (10). The sideways movement of the infrared heater (52), i.e. in the second direction, is preferably timed according to the movement of the dancing roller (30) and the spraying of the fabric (10). Therefore the fabric can be held in position in a stop-start nature to allow sections of the fabric (10) to be acted on at once. Alternatively, or additionally, the drier (52) may rotate away from the fabric (10) such that the drying rate of the fabric (10) is reduced even if the drier (52) remains on. Additionally, air movement over the fabric (10) may be used by blowing or suction force in order to encourage the removal of fluid particles from the fabric (10). Additionally, or alternatively, the infrared drier (52) may move in an up and down direction, i.e. a third direction, which is substantially orthogonal to the first and second directions. This ads further configurability depending on the type of drying required.

After the drying station (50), the fabric is sent through a printing station, which may be a separate station. When an inkjet printer is used (not shown), the printing nozzles acting on the fabric (10) move across the fabric (10) in a side-to-side motion. During the sideways movement of the nozzles, the fabric (10) is held substantially stationary in order to allow the ink to be passed onto the fabric (10) in a linear fashion. An array of nozzles arranged in a column (i.e. along the fabric (10)) may be used in order to concurrently move across the fabric (10) and act on a larger surface area. This allows a row of the fabric (10) to be printed on at once (as determined by the dancing roller (30)) before being moved out of the way by the next row of unprinted fabric (10). Advantageously, the continuous motion of the cleaning station (20) does not disrupt the stop-start motion required by the printing station (60).

Figure 6:
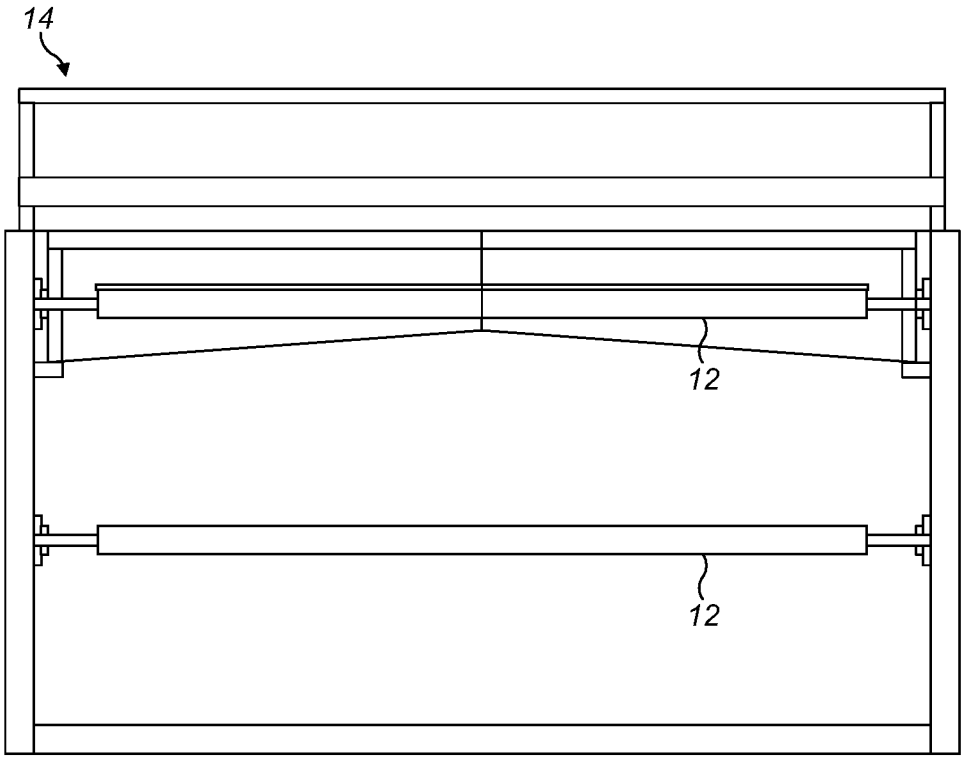

FIGS. 5 and 6 show the front and back views of the apparatus, respectively. Typically, the rollers (12) are elongate to reduce inertial load and accommodate fabric (10) that may be at least 3m in width. The rollers (12) each has a rotation axis which may be powered or unpowered. Therefore, some rollers (12) may be used to drive the fabric (10) forward or may freewheel such that they spin freely. The axes of the rollers (12) are shown attached to framework (14) that provides the structure of the apparatus (100).

Figure 7:
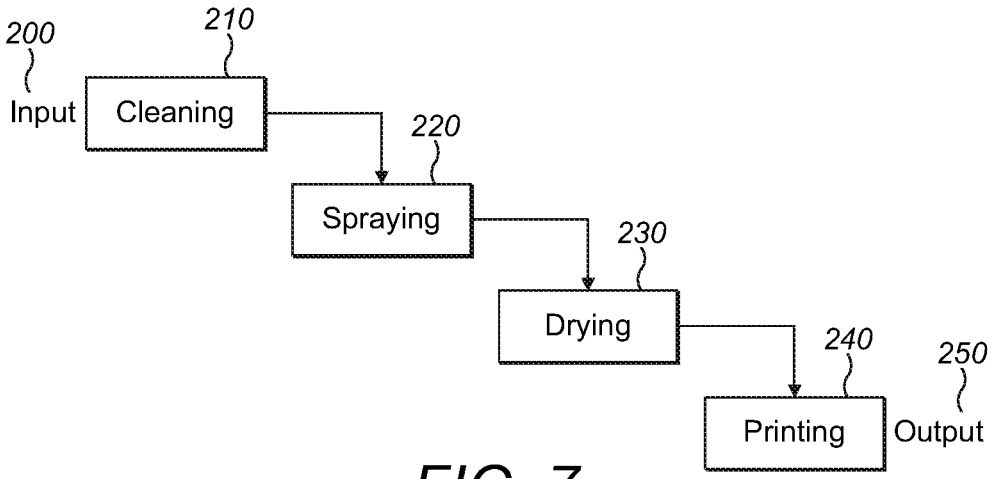
FIG. 7 shows a flow diagram of the treatment and printing processes.

FIG. 7 shows a flow diagram of the apparatus (100) as a whole. The apparatus (100) is configured to receive a roll of fabric (10) and input the fabric (10) as a continuous length. After the input stage (200), the fabric is continuously fed to a cleaning stage (210), where debris is removed from the fabric (10) from at least one side of the fabric (10). The continuous motion of the fabric (10) movement is then changed into intermittent motion. Therefore sections of the fabric (10) are then fed to a spraying stage (220), whereby the fabric (10) is coated from at least one side with a pre-treatment fluid. The amount of penetration is controlled in order to embed the fabric (10) accordingly. After the spraying stage (220), sections of the fabric (10) are intermittently fed to a drying station (230), where the fabric (10) is dried in and the pre-treatment fluid is retained by the fabric (10). This drying action may extend to a heating action in order to prepare the fabric (10) for printing by inkjet. Once exposed to a drier in the drying stage (230), the fabric (10) is fed to a printing stage (240), whereby the fabric (10) is printed on by ink. This allows graphics to be applied to the pre-treated and dried fabric (10) before being outputted (250) for delivery or storage.

Advantageously, the apparatus minimises changeover disruption so that a different pre-treatment chemical can be quickly and more conveniently changed. The extent of chemical penetration into the fabric can be controlled by the use of nozzles to provide a more flexible method of coating the fabric. The moveable drier and/or improved transient nature of the drier prevents the fabric being scorched and allows the drying process to be unaffected when stationary. The moveable drying and/or spraying zone allows the fabric to be held in position. In summary, the apparatus provides greater customisation and flexibility for improved efficiency and reduced downtime.

Whilst the parts of the system operate exemplarily together, each various part may also be used in isolation and provide benefits to known drying or coating systems. In particular, it has been found that the material treatment station can be used in isolation to provide advantages over known padding and stenter processes. For instance, it has been found that by spraying the treatment a lower amount of chemicals need to be used in the treatment. That is, in the padding and stenter process, the fabric absorbs more treatment fluid than it needs, Whereas by spraying a more controlled delivery process is achieved. As such, not only can the coating be completed with less chemicals, but because less chemicals are used, different chemicals can be used. Moreover, the padding and stenter process uses a relatively dilute treatment, for instance around 80% water. In contrast, a less dilute treatment fluid can be used in the spray treatment process herein described because the treatment process is more controlled. As such, it has been found that significant energy savings can be made due less energy being required to evaporate the water from the treatment from the substrate.

Advantageously the method of coating and the spray coating apparatus provides a more uniform distribution of fluid, particularly at the joins between successive spray zones. A further advantage is that the printing on the fabric is effected at a faster speed.

Although preferred embodiment(s) of the present invention have been shown and described, it will be appreciated by those skilled in the art that changes may be made without departing from the scope of the invention as defined in the claims.

The invention claimed is:

1. A method of coating a substrate comprising:

causing at least one nozzle to at least partially traverse a length of fabric in one direction whilst causing fluid to be emitted and thereby to be coated onto the fabric unevenly in a direction perpendicular to the one direction in a first spray zone by oscillating the at least one nozzle in the direction perpendicular to the one direction and causing the at least one nozzle to subsequently traverse a second length of fabric in a second direction whilst causing fluid to be emitted and thereby to be coated onto the fabric unevenly in a direction perpendicular to the second direction in a second spray zone by oscillating the at least one nozzle in the direction perpendicular to the second direction, wherein the first and second spray zones are arranged to overlap;

wherein the method comprises causing the at least one nozzle to oscillate in a back-and-forth swinging motion so that the spray zone is caused to have a heaviest distribution of fluid in the centre of each spray pattern and a lightest distribution of fluid at the two extremes of each spray pattern.

2. The method as claimed in claim 1 comprising causing relative movement of the fabric and the at least one nozzle after causing the at least one nozzle to at least partially traverse the length of fabric in the one direction and before causing the at least one nozzle to subsequently traverse the second length of fabric in the second direction with there being a partial overlap of coating between the first and second spray zones.

3. The method as claimed in claim 1 comprising varying the amount of fluid being emitted during different parts of the oscillation movement.

4. A method of coating a substrate comprising:

causing at least one nozzle to at least partially traverse a length of fabric in one direction whilst causing fluid to be emitted and thereby to be coated onto the fabric unevenly in a direction perpendicular to the one direction in a first spray zone by oscillating the at least one nozzle in the direction perpendicular to the one direction and causing the at least one nozzle to subsequently traverse a second length of fabric in a second direction whilst causing fluid to be emitted and thereby to be coated onto the fabric unevenly in a direction perpendicular to the second direction in a second spray zone by oscillating the at least one nozzle in the direction perpendicular to the second direction, wherein the first and second spray zones are arranged to overlap;

wherein the method comprises arranging the at least one nozzle to have a primary fluid emission direction that is angled to the vertical so that the each spray zone is caused to have the heaviest distribution of fluid nearest the at least one nozzle and the lightest distribution of fluid furthest from the at least one nozzle.

5. The method of claim 4 comprising causing the at least one nozzle to be oscillated whilst spraying.

6. The method as claimed in claim 5 wherein the one direction and the second direction are opposite to each other.

7. The method as claimed in claim 4 comprising causing relative movement of the fabric and the at least one nozzle after causing the at least one nozzle to at least partially traverse the length of fabric in the one direction and before causing the at least one nozzle to subsequently traverse the second length of fabric in the second direction, with there being a partial overlap of coating between the first and second spray zones.

8. The method as claimed in claim 4 comprising varying the amount of fluid being emitted during different parts of the oscillation movement.

9. A spray coating apparatus arranged, in use, to coat onto a substrate, the spray coating apparatus comprising:

a carriage carrying a nozzle, the carriage being arranged, in use, to carry the nozzle in a first direction and at least partially traverse a fabric with the nozzle being arranged to emit an uneven distribution of fluid in a second direction defining a non-zero angle relative to the first direction, wherein the nozzle is pivotally mounted to the carriage, wherein:

the nozzle is mounted to the carriage with an oscillator arranged, in use, to cause the nozzle to be oscillated back and forth in the second direction, and the apparatus further comprises a fluid supply means to supply fluid to the nozzle so that fluid is sprayed from the nozzle as it simultaneously traverses and oscillates, and the oscillator includes a reciprocating lever which is connected to the nozzle at a location spaced from a pivotal connection of the nozzle and which causes the nozzle to oscillate.

10. The spray coating apparatus as claimed in claim 9 in which the carriage is arranged to carry the nozzle in a first direction, which is perpendicular to the second direction of oscillation.

11. The spray coating apparatus as claimed in claim 9 including at least two nozzles each carried by a carriage and caused to at least partially traverse the fabric in one direction and each nozzle including an oscillator arranged to cause fluid to be emitted whilst simultaneously traversing and oscillating.

12. The spray coating apparatus as claimed in claim 9 including a controller arranged, in use, to control any one or more of a frequency of oscillation of the oscillator, a speed of movement of the carriage, a rate of fluid being emitted by the nozzle or a distance between the nozzle and a fabric.

13. The spray coating apparatus as claimed in claim 9 in which the reciprocating lever is pivotally mounted on the nozzle and the lever, in use, is caused to reciprocate by a further lever pivotally connected to the reciprocating lever, the further lever also being pivotally connected to a rotating member at a distance from the pivotal connection of the rotating member.

14. The spray apparatus as claimed in claim 13 in which the rotating member is caused, in use, to rotate by frictionally engaging a belt of the carriage, which belt effects movement of the nozzle in the first direction.

15. The spray apparatus as claimed in claim 9 including a motor arranged, in use, to cause the nozzle to reciprocate.

16. The spray coating apparatus of claim 9, wherein the nozzle is pivotally mounted to the carriage such that the nozzle can rotate about at least one axis defining a non-zero angle relative to the second direction.

17. The spray coating apparatus of claim 16, wherein the nozzle is mounted to the carriage with an oscillator arranged, in use, to cause the nozzle to be oscillated back and forth in the second direction.

18. The spray coating apparatus of claim 17, wherein the oscillator is configured to rotate the nozzle about the least one axis defining a non-zero angle relative to the second direction.

* * * * *